US012000109B2

(12) United States Patent
Peat et al.

(10) Patent No.: US 12,000,109 B2
(45) Date of Patent: Jun. 4, 2024

(54) SCRAPER CONTROL METHOD

(71) Applicant: Deere & Company, Moline, IL (US)

(72) Inventors: Michael D. Peat, Dubuque, IA (US); Francois Stander, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 393 days.

(21) Appl. No.: 17/445,884

(22) Filed: Aug. 25, 2021

(65) Prior Publication Data

US 2023/0066877 A1 Mar. 2, 2023

(51) Int. Cl.
*E02F 3/65* (2006.01)
*E02F 3/64* (2006.01)

(52) U.S. Cl.
CPC ..... *E02F 3/652* (2013.01); *E02F 3/6481* (2013.01); *E02F 3/651* (2013.01)

(58) Field of Classification Search
CPC ..... E02F 3/652; E02F 3/6481; E02F 3/651
See application file for complete search history.

(56) References Cited

U.S. PATENT DOCUMENTS 6,336,068 B1 * 1/2002 Lawson ..... E02F 3/6481 701/34.2
10,066,367 B1 * 9/2018 Wang ..... E02F 9/262
2008/0230244 A1 * 9/2008 Moyna ..... E02F 3/6481 172/396
2013/0158817 A1 * 6/2013 Kingdon ..... E02F 3/6481 701/50

OTHER PUBLICATIONS

Brochure of MT-42 XL Truck-Towed Scraper, 2 pages.

* cited by examiner

*Primary Examiner* — Navid Z. Mehdizadeh
*Assistant Examiner* — Shelley Marie Osterhout

(57) ABSTRACT

A control method to operate a scraper over ground, the control method comprising: receiving a signal indicative of a desired attack angle between a cutting edge of the scraper and the ground; receiving a height control signal to control a cutting edge height; receiving one or more measuring signals from one or more sensors, calculating a measured attack angle based on the one or more measuring signals; comparing the measured attack angle and the desired attack angle; and outputting at least one control signal commanding movement of a bowl of the scraper based on the height control signal and a result of the comparing the measured attack angle and the desired attack angle.

17 Claims, 9 Drawing Sheets

SCRAPER CONTROL METHOD

RELATED APPLICATIONS

N/A.

FIELD OF THE DISCLOSURE

The present disclosure relates generally to a scraper.

BACKGROUND OF THE DISCLOSURE

A scraper is a type of earth moving device that is used to engage and collect the material from the ground, to transport the material, and to unload the material in a designated area. The scraper includes a bowl configured to receive the material. The scraper is coupled to a work vehicle via a hitch. The scraper includes at least one ground engaging device (e.g., a pair of wheels or tracks) coupled to a rear portion of the bowl and used for moving the scraper when the scraper is pulled by the work vehicle.

The scraper may have three primary operations, including loading, transporting, and unloading operations.

The scraper has a cutting edge to engage the ground and separate the material from the surface of the ground. An attack angle is defined between the cutting edge and the ground. The scraper has a gate (apron) in the front of the scraper bowl and an ejector positioned inside of the bowl and located at a rear location of the bowl. In the loading operation, the cutting edge engages the ground and the separated material (e.g., dirt) flows from the ground. The gate opens a limited amount to permit the material flow into the bowl but keeps the material from flowing out. In the unloading operation, the gate is opened, and the ejector pushes the material forward out the opening created between the gate and the cutting edge.

The scraper has a hydraulic cylinder, one end of which coupled to a front portion of the bowl and the other end of which coupled to the hitch or other part of the work vehicle. The scraper may also have a single pivot unit positioned at a rear portion of the scraper. For example, the single pivot unit may be positioned on a portion of a frame between the pair of the wheels and aligned with an axis transverse to a longitudinal axis of the scraper. When the hydraulic cylinder extends or retracts to lower or raise the front of the bowl, the bowl pivots about the transverse axis through the single pivot unit. The cutting edge engages the ground when the bowl pivoted about the transverse axis toward the ground. The attack angle may only be determined by the distance from the pivot unit (point) to the cutting edge.

Another type of scraper has more than one single pivot units, providing a vertical shift of the transverse axis the bowl pivots around, adding the ability to change the cutting edge attack angle by controlling the height of the pivot point (s) from the ground plane. In other word, changing the attach angle may require raise or lower the front and rear portions of the bowl in different extent at the same time, which is hard, burdensome, and time-consuming for the operator.

SUMMARY OF THE DISCLOSURE

According to an aspect of the present disclosure, a control method to operate a scraper over ground, the control method comprising: receiving a signal indicative of a desired attack angle between a cutting edge of the scraper and the ground; receiving a height control signal to control a cutting edge height; receiving one or more measuring signals from one or more sensors, calculating a measured attack angle based on the one or more measuring signals; comparing the measured attack angle and the desired attack angle; and outputting at least one control signal commanding movement of the bowl based on the height control signal and a result of the comparing the measured attack angle and the desired attack angle.

Other features and aspects will become apparent by consideration of the detailed description and accompanying drawings.

BRIEF DESCRIPTION OF THE DRAWINGS

The detailed description of the drawings refers to the accompanying figures in which.

DETAILED DESCRIPTION OF THE DRAWINGS

Figure 1:
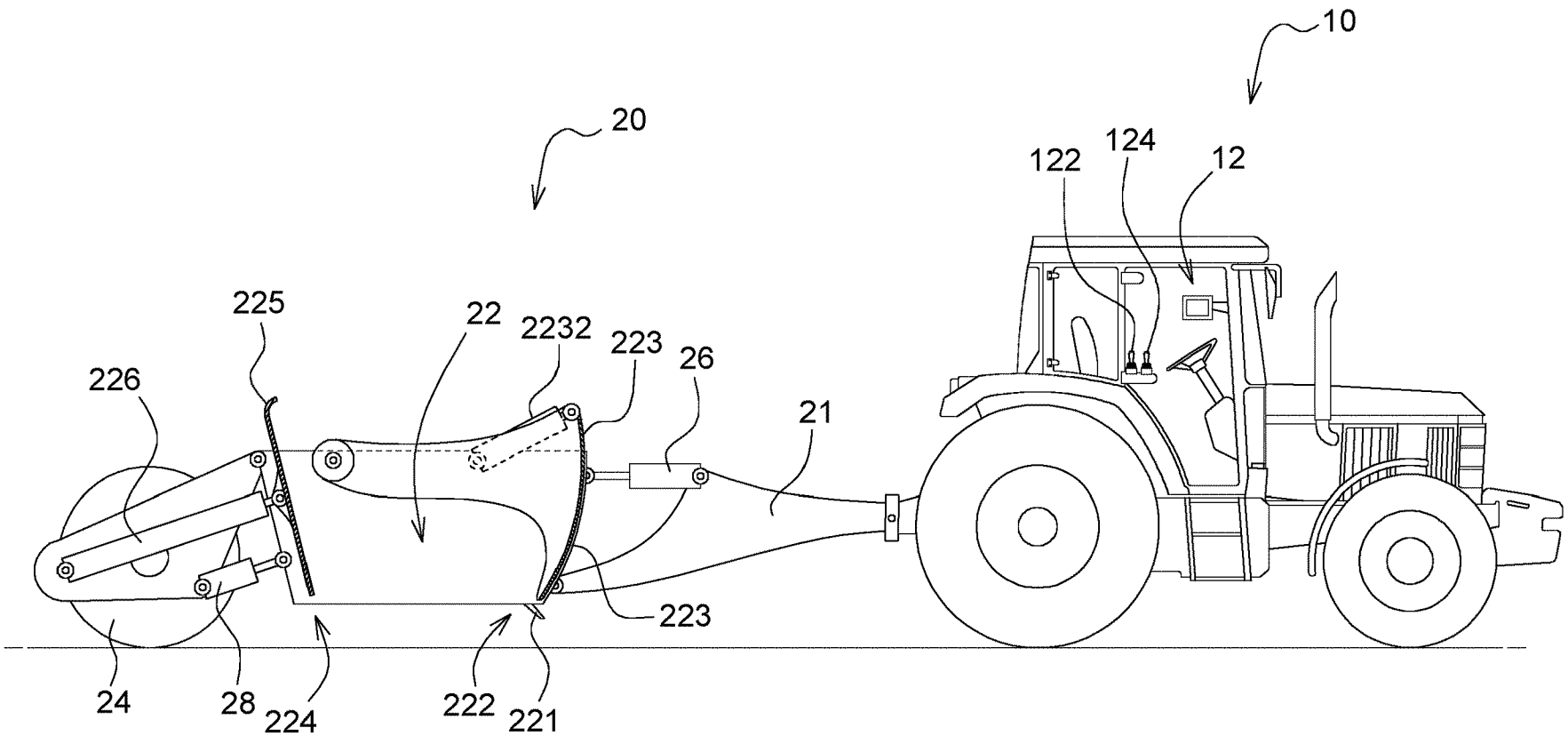
FIG. 1 is a side view of a scraper having a bowl and a work vehicle.

The present disclosure includes a scraper that can substantially adjust an attack angle between the cutting edge of the scraper and the ground. To adjust the attack angle, the scraper includes two pivot units, described in later description. When a scraper scrapes hard ground, the operator may prefer to have a shallow attack angle because a steep attack angle between the cutting edge and the ground may damage the cutting edge. In addition, when the scraper is collecting material on the ground, the cutting edge with steep attack angle on the hard ground requires more tractive force, which could result in unnecessary wheel slip. On the contrary, when the scraper scrapes soft ground, the operator may prefer to have a steep attack angle to increase the efficiency of the loading performance. In order to adjust the attack angle, a first actuator is coupled to the first portion (e.g., the front portion) of the bowl and a second actuator is coupled to the second portion (e.g., the rear portion) of the bowl so as to raise or lower the front portion and the rear portion of the bowl.

However, controlling the first actuator (front bowl lift) and the second actuator (rear bowl lift) to control the height of the front portion of the bowl and the height of the second portion of the bowl at the same time to further adjust the attack angle may be difficult for some operators. They may manually set the rear portion of the bowl in a certain height and merely use the first actuator to raise or lower the cutting edge. The repeatability of this procedure may also be burdensome to the operators. If the operators want an attack angle which requires them to be in the middle of the range of the front bowl lift or rear bowl lift, repeatably getting the same attack angle cycle to cycle is difficult. In addition, as the operators move either the front bowl lift or rear bowl lift independently from the other, the attack angle changes away from what could be set nominally for cutting performance. Furthermore, when the scraper transports, with the front portion of the bowl raised, the pre-set height of the rear portion of the bowl may not be high enough. An obstacle or a bump of the terrain may hit the bottom of the bowl during the transportation. Therefore, the present disclosure includes a method to adjust an attacking angle and also ensure the clearance between the bottom of the bowl and the ground is achieved.

The present disclosure includes a system that allows an operator to set a desired attack angle. A controller of the system is configured to control of the first actuator and the second actuator to change the actual attack angle (i.e., measured attack angle) to achieve the desired attack angle or to maintain the actual attack angle (i.e., measured attack angle) the same as the desired attack angle.

When the operator uses an operator interface such as a joystick, to request the cutting edge lower, sensor(s) of the scraper transmit signals for the controller to calculate the measured attack angle and/or the measured cutting edge height. In one condition, if the measured attack angle is equal to the desired attack angle, the first actuator and the second actuator will respectively lower the front portion and the rear portion of the bowl, so as to lower the cutting edge height and to maintain the desired attack angle. In another condition, if the measured attack angle is still shallower than the desired attack angle (for example, the scraper starts from the traveling position, i.e., the bowl is at a store location), the first actuator extends or retracts, depending on how it is configured, to lower the front portion of the bowl and increase the measured attack angle until the measured attack angle is equal to the desired attack angle. Alternatively or concurrently, the second actuator extends or retracts, depending on how it is configured, to raise the rear portion of the bowl and increase the measured attack angle until the measured attack angle is equal to the desired attack angle. After the measured attach angle is equal to the desired attack angle, as previously described condition, and the operator continues to request the cutting edge lower, the first actuator and the second actuator will respectively lower the front portion and the rear portion of the bowl, so as to lower the cutting edge height and to maintain the desired attack angle.

When the operator uses an operator interface such as a joystick, to request the cutting edge to raise, sensor(s) of the scraper transmit signals for the controller to calculate the measured attack angle and/or the measured cutting edge height. The measured attack angle, at the beginning, may be equal to the desired attack angle because the bowl had been lowered and later maintained the measured attack angle equal to the desired attack angle during the lowering process, as described previously. Therefore, during the bowl raising, the controller determines whether one of the first actuator and the second actuator is fully raised. Such determination, for example, is based on signal(s) transmitted by the sensor(s), which will be discussed later. In one condition, if one of the first actuator or the second actuator is fully raised and the operator still requests the cutting edge to raise, the other one of the first actuator or the second actuator will continue to raise the bowl to reach a maximum transport height of the bowl (a store position) for transportation of the scraper, with the gate fully closed. The implementations in detail will be described later. In another condition, if neither one of the first actuator or the second actuator is fully raised, the first actuator and the second actuator will respectively raise the front portion and the rear portion of the bowl, so as to raise the cutting edge height and to maintain the desired attack angle.

Referring to FIG. 1, a scraper 20 is coupled to a work vehicle 10 via a hitch 21, which may be gooseneck hitch or a straight hitch, depending on the work vehicle it connects. The work vehicle 10 hauls the scraper 20 to remove material from the ground. The work vehicle 10 in this implementation is tractor. The scraper 20 includes a bowl 22, at least one ground engaging device 24, a first actuator 26, and a second actuator 28. The work vehicle 10 in FIG. 1, the tractor, is shown only for explanatory purpose. In another implementation, the work vehicle 10 can be articulated truck (not shown). Alternatively, two different vehicles 10 (not shown) may move the scraper 20 together. For example, one work vehicle hauls the scraper 20 and the other work vehicle pushes the scraper 20. In another implementation, the work vehicle 10 can be eliminated or integrated into the scraper 20 to form a self-propelled scraper without other vehicles providing external forces (not shown).

Figure 2A:
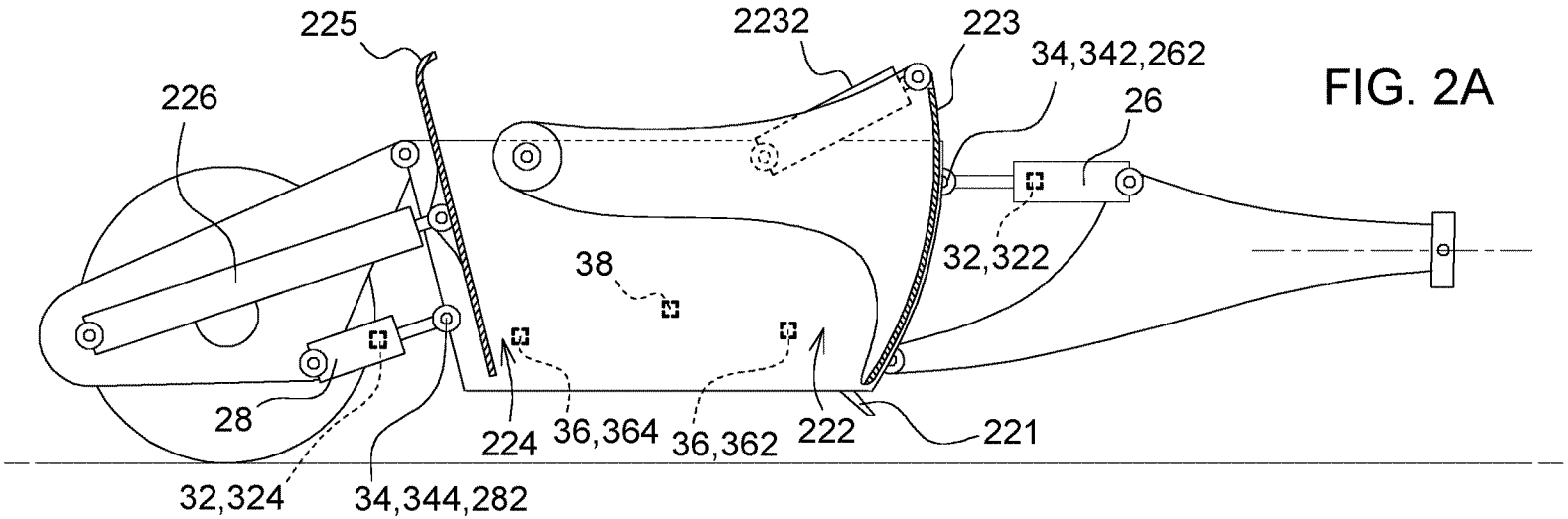
FIG. 2A illustrates the bowl in a travel (store) position and potential locations of sensors.
Figure 2B:
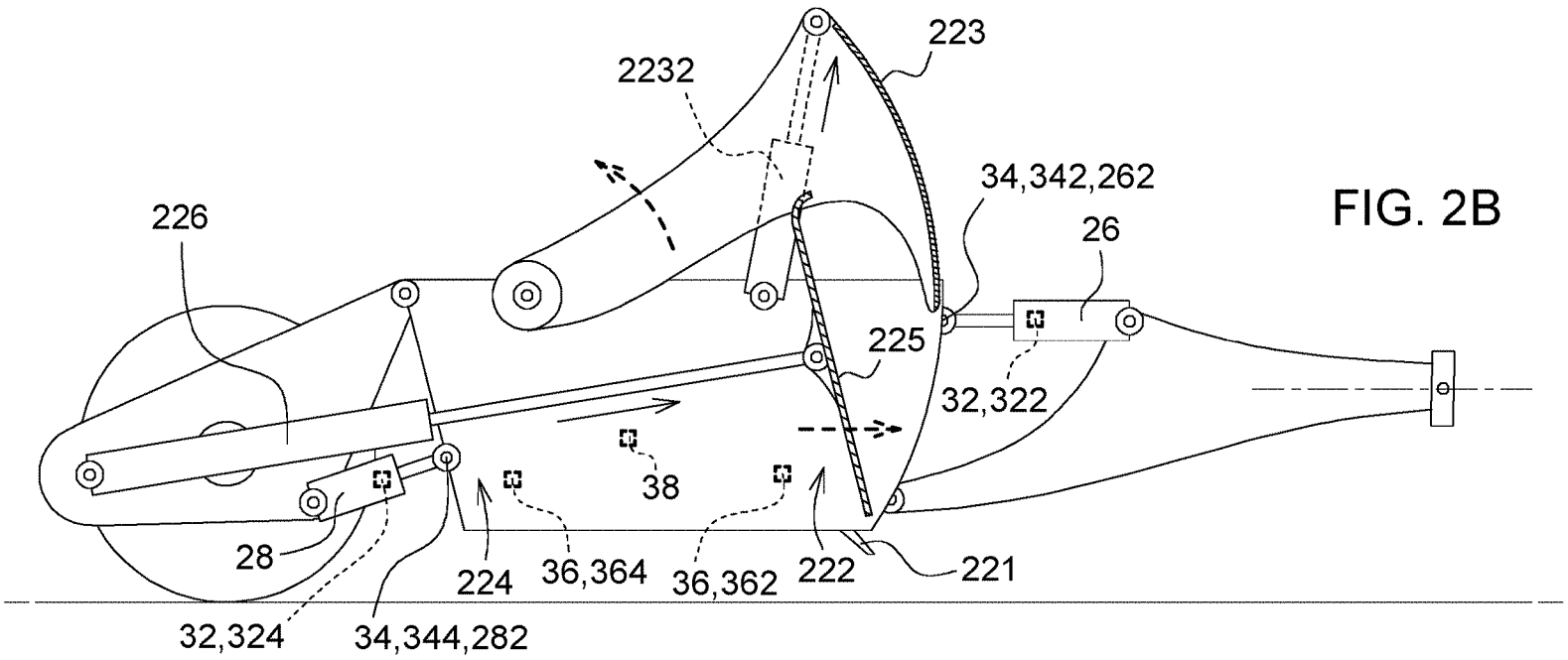
FIG. 2B illustrates the bowl in an unloading position.
Figure 2C:
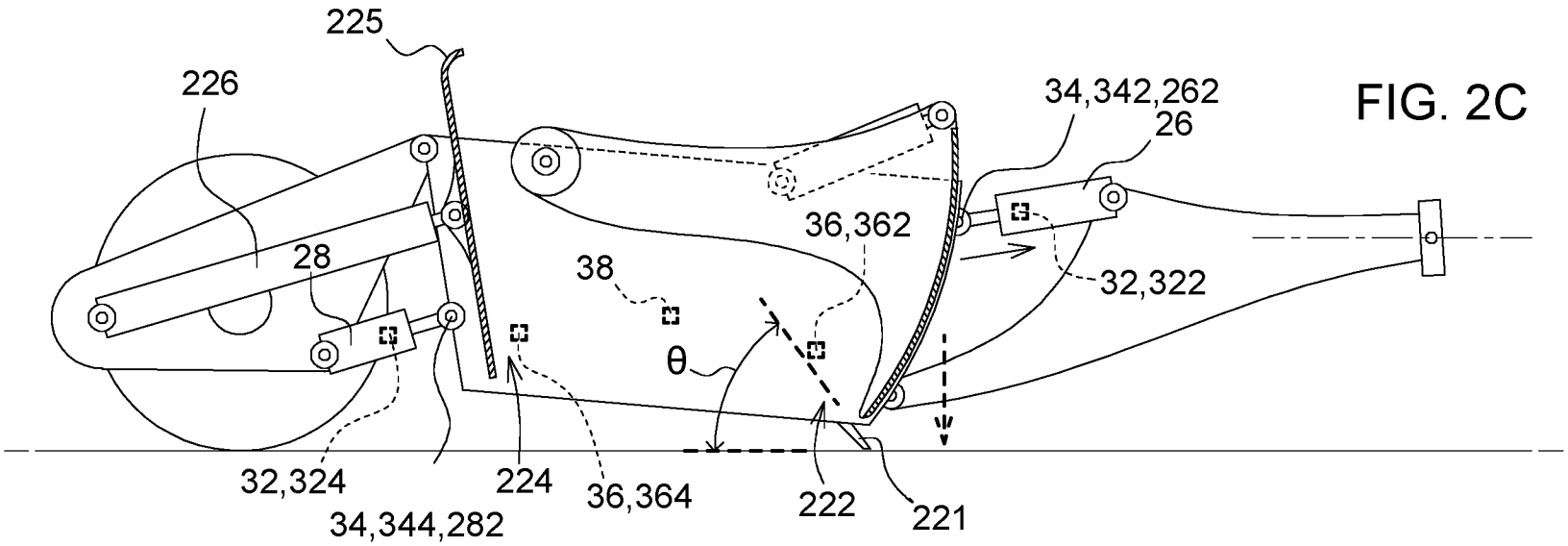
FIG. 2C illustrates the front portion of the bowl lowered to engage the ground.

Referring to FIGS. 1 and 2A-2D, the scraper 20 may have three operations, including loading, transporting, and unloading operations. The bowl 22 is used to receive the material 90 from the ground when the scraper 20 performs a loading operation. The bowl 22 includes a front portion 222 and a rear portion 224. A cutting edge 221 (e.g., a cutting blade) of the bowl 22 is affixed to a lower part of the front portion 222 and selectively contacts the ground to remove the material 90. As shown in FIG. 2C, the front portion 222 of the bowl 22 is lowered to engage the ground and ready for loading operation. An attack angle θ is defined between the cutting edge 221 and the ground. The bowl 22 includes a gate 223 positioned at the front portion 222 of the bowl 22 and an ejector 225 positioned inside of the bowl 22 and selectively pushing materials inside the bowl 22 toward the gate 223 via a pushing actuator 226.

In the loading operation, while the work vehicle 10 moves forward, the cutting edge 221 of the scraper 20 engages the ground and the material 90 is separated from the ground, and the gate 223 opens a limited amount to permit the material 90 to enter the bowl 22 while positioned to keep the material 90 from flowing out. When the material 90 accumulates in the bowl 22 in a preferable amount, the operator may decide to lift the bowl 22 to perform the transporting operation (travel position), as shown in FIG. 2A. In the transporting operation, the bowl 22 is raised to a store position, which provides sufficient distance between the bottom of the bowl 22 and the ground such that a bump or an object on the ground may not easily hit the bowl 22 while the work vehicle 10 is hauling the scraper 20. In addition, the gate 223 is fully closed during the transporting operation. When the scraper 20 reaches a designate location, as shown in FIG. 2B, the unloading operation is performed. The gate 223 is opened by a gate actuator 2232. At the same time, the pushing actuator 226 extends to move ejector 225. The ejector 225 pushes the material toward the front portion 222 of the bowl 22 to unload the material 90.

The work vehicle 10 includes an operator interface 12 and a controller 14. The scraper 20 includes one or more sensors 30, which are shown in FIGS. 1 and 2A-2E. The operator interface 12 is used for adjusting the attack angle θ and the cutting edge height (the height of the cutting edge 221 relative to the ground). The operator interface 12 includes, for example, a joystick 122 and a joystick 124. The operator may use the joystick 122 to adjust a desired attack angle that fits the types of the materials 90. Alternatively, the operator may use a touch screen, a switch, a knob, a voice control device (not shown), or other means to set up or adjust the desired attack angle. A signal indicative of the desired attack angle from the joystick 122 will later be received by the controller 14.

The operator may use a joystick 124 to increase or decrease the cutting edge height (and/or set up a desired cutting edge height); the height adjustment is completed by pushing or pulling the lever. Alternatively, the operator may use the joystick 122, a touch screen, a switch, a knob, a voice control device, or other means to set up or adjust the cutting edge height. A height control signal from the joystick 124 to control the cutting edge height is received by the controller 14. In another implementation, a single joystick of the operator interface 12 may adjust the desired attack angle and the cutting edge height.

The controller 14 here is a computing device which includes or is associated with a memory. The data of the attack angle is stored in the memory. The controller 14 may include one or more processing units, which may receive one or more measuring signals from one or more sensors 30 (shown in FIGS. 2A-2E) by the controller 14, calculate a measured attack angle based on the one or more measuring signals from the sensors 30, compare the desired attack angle and a measured attack angle, and output at least one control signal to command movement of the bowl 22 based on the height control signal and a difference between the measured attack angle and the desired attack angle. The movement of the bowl 22 results from extending or retracting at least one of the first actuator 26 coupled to a front portion 222 of the bowl 22 and the second actuator 28 coupled to the rear portion 224 of the bowl 22 based on the at least one control signal. The controller 14 in another implementation may be positioned at the scraper 20 instead of the work vehicle 10 (not shown). In another implementation, some processing units of the controller 14 are positioned at the work vehicle 10 and some processing units of the controller 14 are positioned at the scraper 20. The controller 14 in another implementation may include multiple controllers or processing units in a controller area network (not shown).

In one implementation, the connection between the first actuator 26 or second actuator 28 and the bowl 22 may be a cantilever type-one end of the first actuator 26 mounts on the hitch 21 or a frame of the scraper 20 to which the bowl 22 is configured to move relatively and the other end of the first actuator 26 is pivotably coupled to the front portion 222, as shown in FIGS. 2A-2D; one end of the second actuator 28 mounts on a housing of the axle of the ground engaging device 24 or the frame of the scraper 20 to which the bowl 22 is configured to move relatively and the other end of the second actuator 28 is pivotably coupled to the rear portion 224, as shown in FIGS. 2A-2D. In another implementation, the connection between the first actuator 26 or second actuator 28 and the bowl 22 may be a four-bar linkage type—one end of the first actuator 26 mounts to the hitch 21 or a frame of the scraper 20 to which the bowl 22 is configured to move relatively and the other end of the first actuator 26 connects a linkage that is pivotably coupled to the front portion 222; one end of the second actuator 28 mounts to a housing of the axle of the ground engaging device 24 or the frame of the scraper 20 to which the bowl 22 is configured to move relatively and the other end of the second actuator 28 connects another linkage that is pivotably coupled to the rear portion 224. The connections described herein are only for demonstration. The first actuator 26 (or the second actuator 28) may extend to raise the front portion 222 (or rear portion 224) of bowl 22 or retract to raise the front portion 222 (or rear portion 224) of bowl 22, depending on which direction of a rod end of the first actuator 26 (or the second actuator 28) extends.

Figure 2D:
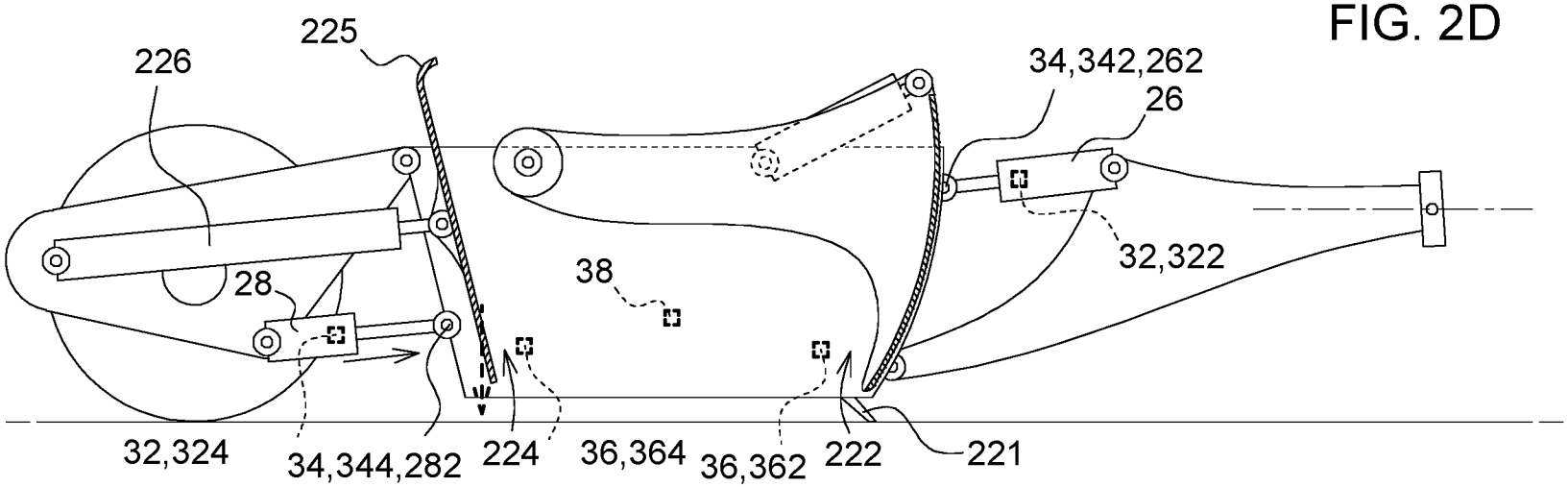
FIG. 2D illustrates the rear portion of the bowl lowered to change an attack angle.

Referring to FIGS. 1, 2C and 2D, the movement of the first actuator 26 and the second actuator 28 adjust the height of pivot units 262, 282, which results a vertical shift of the transverse axis the bowl pivots around. As such, it adds the ability to control the cutting edge attack angle by adjusting the height of the pivot units 262, 282 from the ground plane. FIG. 2C illustrates that the first actuator 26 retracts to lower the front portion 222 of the bowl 22 and FIG. 2D illustrates that the second actuator 28 extends to lower the rear portion 224 of the bowl 22, so as to make the attack angle sallower than that in FIG. 2C. Again, the arrangement of the first actuator 26 and second actuator 28 described in FIGS. 2A-2D are explanatory and can be replaced by different arrangements. For example, FIGS. 3A-5C demonstrate simplified and different arrangement of the first actuator 26 and the second actuator 28.

FIGS. 2A-2E demonstrates different types of sensors 30 transmitting one or more measuring signals received by the controller 14. Referring to FIGS. 2A-2E, the one or more sensors 30 includes one or more displacement sensors 32, including a first displacement sensor 322 and a second displacement sensor 324. The first displacement sensor 322 is positioned on or adjacent to the first actuator 26 to measure the displacement/movement of the first actuator 26. The second displacement sensor 324 is positioned on or adjacent to the second actuator 28 to measure the displacement/movement of the second actuator 28. The measuring signals from the first displacement sensor 322 and the second displacement sensor 324 are received by the controller 14. The controller 14 calculates the measured attack angle based on the measuring signals from the first displacement sensor 322 and the second displacement sensor 324, and the prestored geometric data prestored in the memory. The prestored geometric data includes the distance between the location where the first actuator 26 is coupled and the location where the second actuator 28 is coupled, the angle of the cutting edge relative to the bottom of the bowl 22, the directions of the rod ends of the first actuator 26 and the second actuator 28 extend or retract, etc. Concurrently, the controller 14 may also calculate the (measured) cutting edge height based on the measuring signals from the first displacement sensor 322 and the second displacement sensor 324, the geometric data prestored in the memory.

Figure 2E:
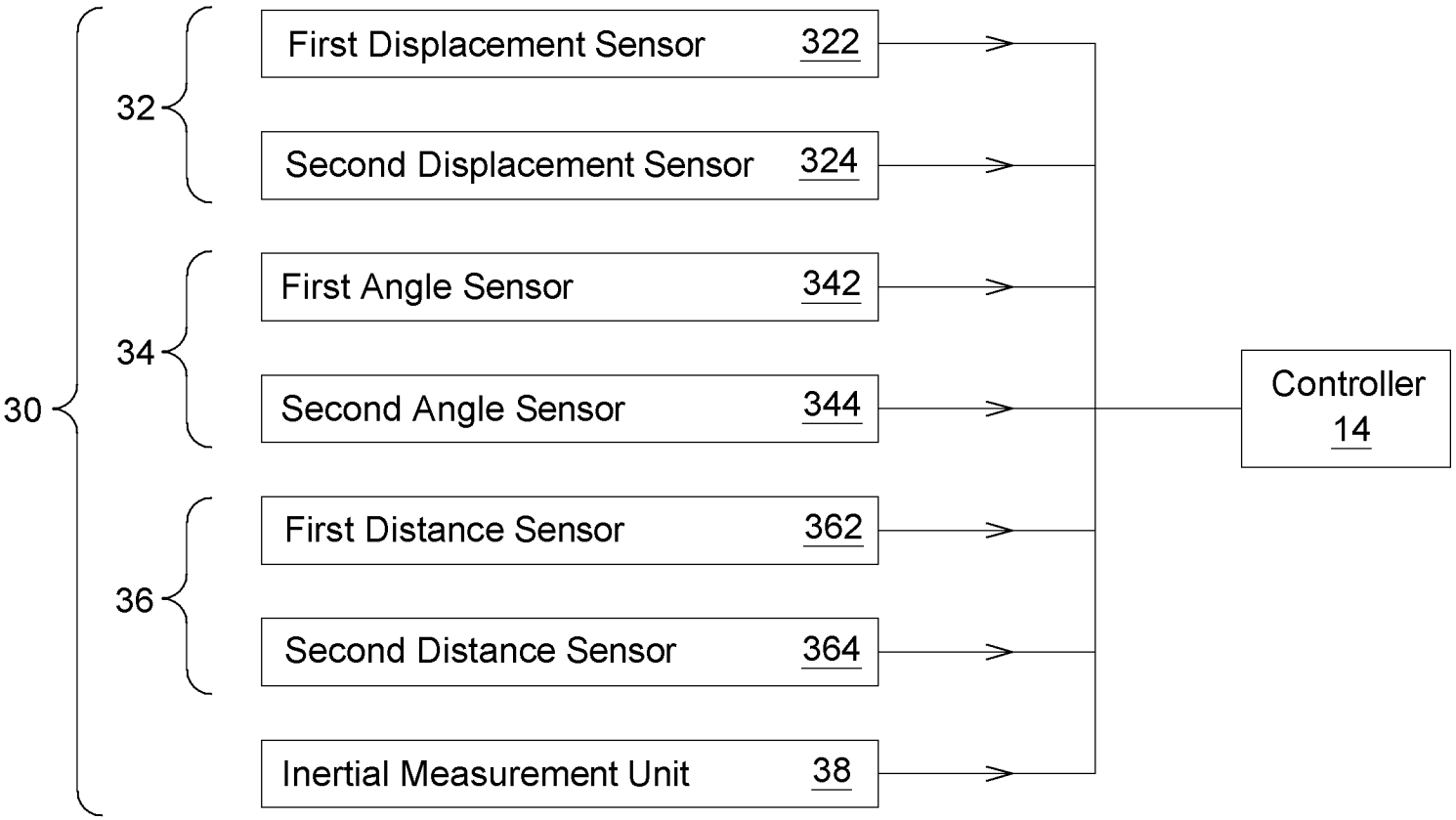
FIG. 2E is a schematic view of the sensors and the controller.

Referring to FIGS. 2C-2E, the one or more sensors 30 includes include one or more angle sensors 34, including a first angle sensor 342 and a second angle sensor 344. The first angle sensor 342 measures a rotation of a first pivot unit 262 caused by the movement of the first actuator 26 and the second angle sensor 344 measures a rotation of a second pivot unit 282 caused by the movement of the second actuator 28. Here, the first pivot unit 262 and the second pivot unit 282 are pins where the first angle sensor 342 and the second angle sensor 344 are positioned on or adjacent to. The first pivot unit 262 and the second pivot unit 282, in one implementation, are connected with the rod ends (or cap ends) of the first actuator 26 and the second actuator 28. The angle of the front portion 222 rotating relative to the rod end (or cap end) of first actuator 26 is measured by the first angle sensor 342 and the angle of the rear portion 224 rotating relative to the rod end (or cap end) of second actuator 28 is measured by the second angle sensor 344. In this implementation, the first angle sensor 342 and the second angle sensor 344 are angular position transducers that convert angular positions or rotations of the first pivot unit 262 and second pivot unit 282 and transmit the measuring signals to the controller 14. The controller 14 calculates the measured attack angle based on the measuring signals from the first angle sensor 342 and the second angle sensor 344, and the geometric data prestored in the memory. Concurrently, the controller 14 may also calculate the (measured) cutting edge height based on the measuring signals from the first displacement sensor 322 and the second displacement sensor 324, the geometric data prestored in the memory. In different implementation, where the connection between the first actuator 26 or second actuator 28 and the bowl 22 may be the four-bar linkage type, the first angle sensor 342 and the second angle sensor 344 measure the rotation of linkages coupling to the front portion 222 and to the rear portion of the bowl 22.

In another implementation, the one or more sensors 30 includes one or more distance sensors 36, including a first distance sensor 362 and a second distance sensor 364. The first distance sensor 362 is positioned on the front portion 222 and measures its height relative to the ground. The second distance sensor 364 is positioned on the rear portion 224 and measures its height relative to the ground. The measuring signals from the first distance sensor 362 and the second distance sensor 364 are received by the controller 14. The controller 14 calculates the measured attack angle based on the measuring signals from the first distance sensor 362 and the second distance sensor 364, and the geometric data prestored in the memory. Concurrently, the controller 14 may also calculate the (measured) cutting edge height based on the measuring signals from the first distance sensor 362 and the second distance sensor 364, the prestored geometric data prestored in the memory. The first distance sensor 362 and the second distance sensor 364 in this implementation may be ultrasonic sensors.

In another implementation, the one or more sensors 30 includes one inertial measurement unit 38 positioned on the bowl 22 and one of the first displacement sensor 322 and the second displacement sensor 324. In another implementation, one or more sensors 30 includes one inertial measurement unit 38 and one of the first angle sensor 342 and the second angle sensor 344. In another implementation, one or more sensors 30 includes one inertial measurement unit 38 and the first distance sensor 362 and the second distance sensor 364. In another implementation, one or more sensors 30 includes two inertial measurement units 38. It is noted that the types of the one or more sensors 30 described herein are only for explanatory purpose. The sensors 30 that measure the height, movement, rotation, relative positions and/or other parameters of the actuators 26, 28, the bowl 22, the linkage and/or any other part of the scraper 20 and transmit measuring signals are in the scope of the sensors 30. In addition, in different implementation, the controller 14 may receive measuring signals from different types of sensors. For example, the sensors 30 include the displacement sensor 32 measuring the movement/displacement of one of the first actuator 26 and the second actuator 28 and an angle sensor 34 measuring a rotation of the second pivot unit 282 caused by the movement of one of the first actuator 26 and the second actuator 28. It is noted that the sensors may be positioned at the work vehicle 10, the scraper 20, or both.

Figures 3A, 3B, 3C:
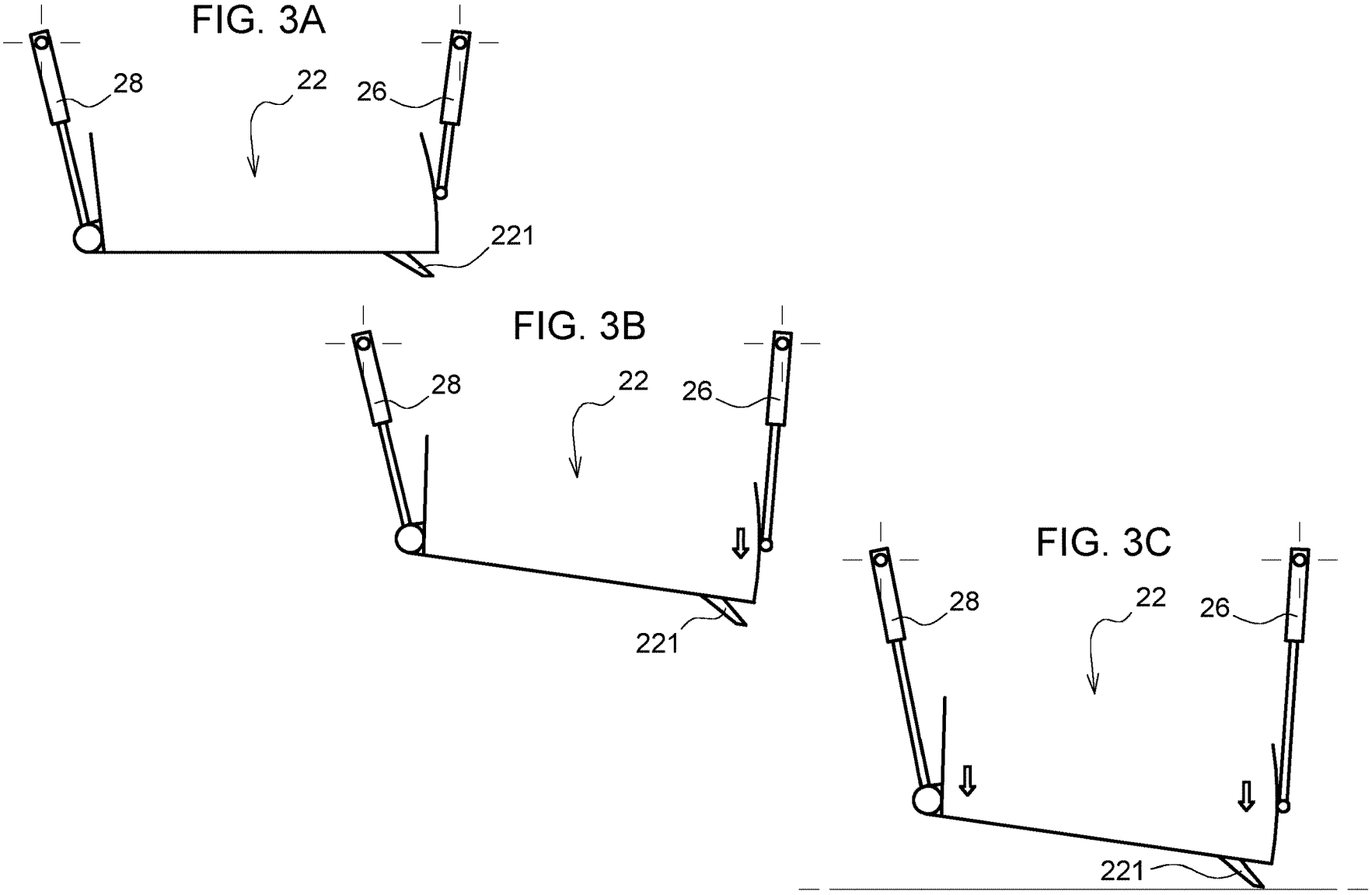
FIG. 3A-3C shows the movement of the bowl in one implementation when an operator lowers the bowl.
Figure 4A:
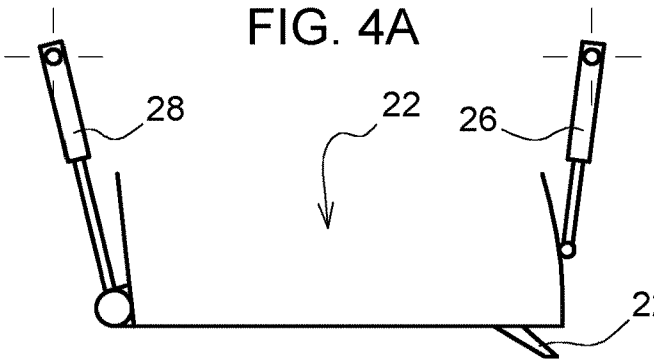
FIG. 4A-4C shows the movement of the bowl in another implementation when the operator lowers the bowl.
Figure 4B:
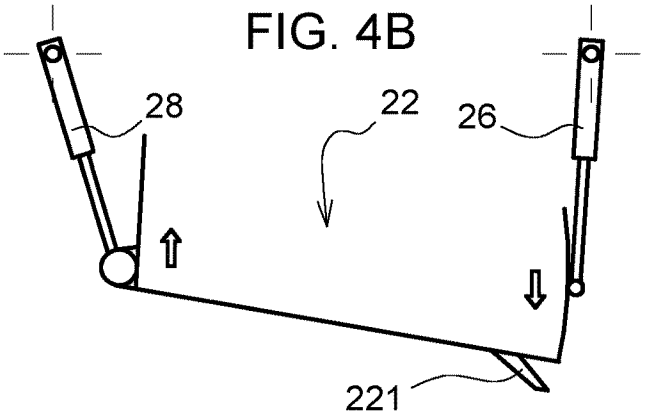
Figure 4C:
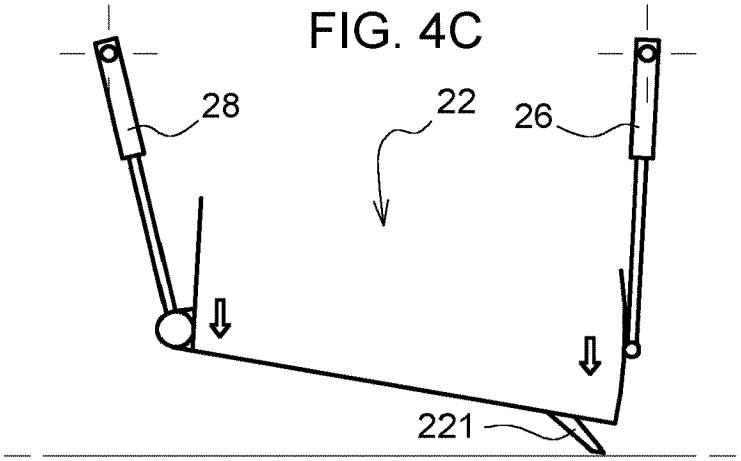
Figures 5A, 5B, 5C:
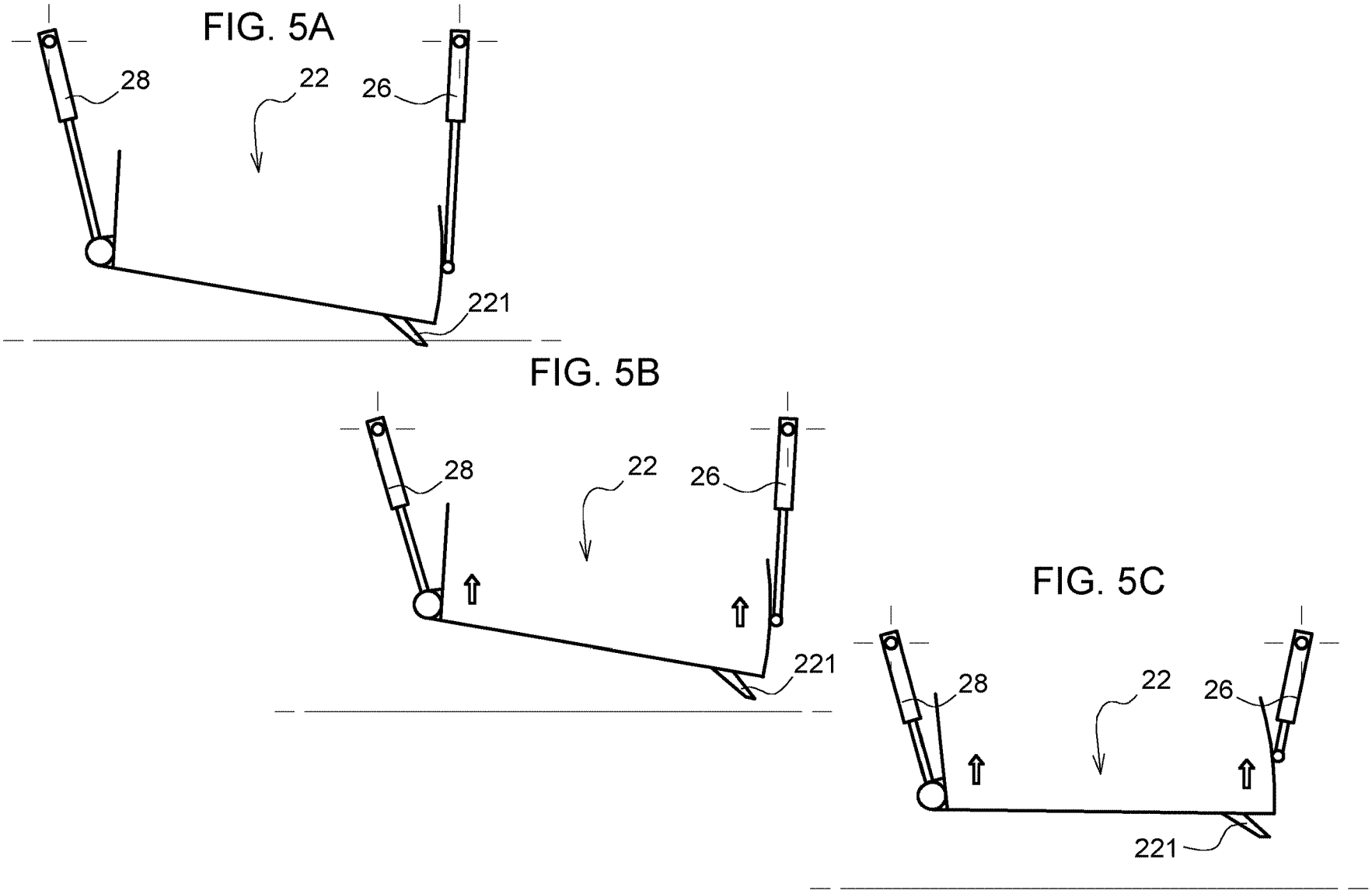
FIG. 5A-5C shows the movement of the bowl in one implementation when an operator raises the bowl.
Figure 6A:
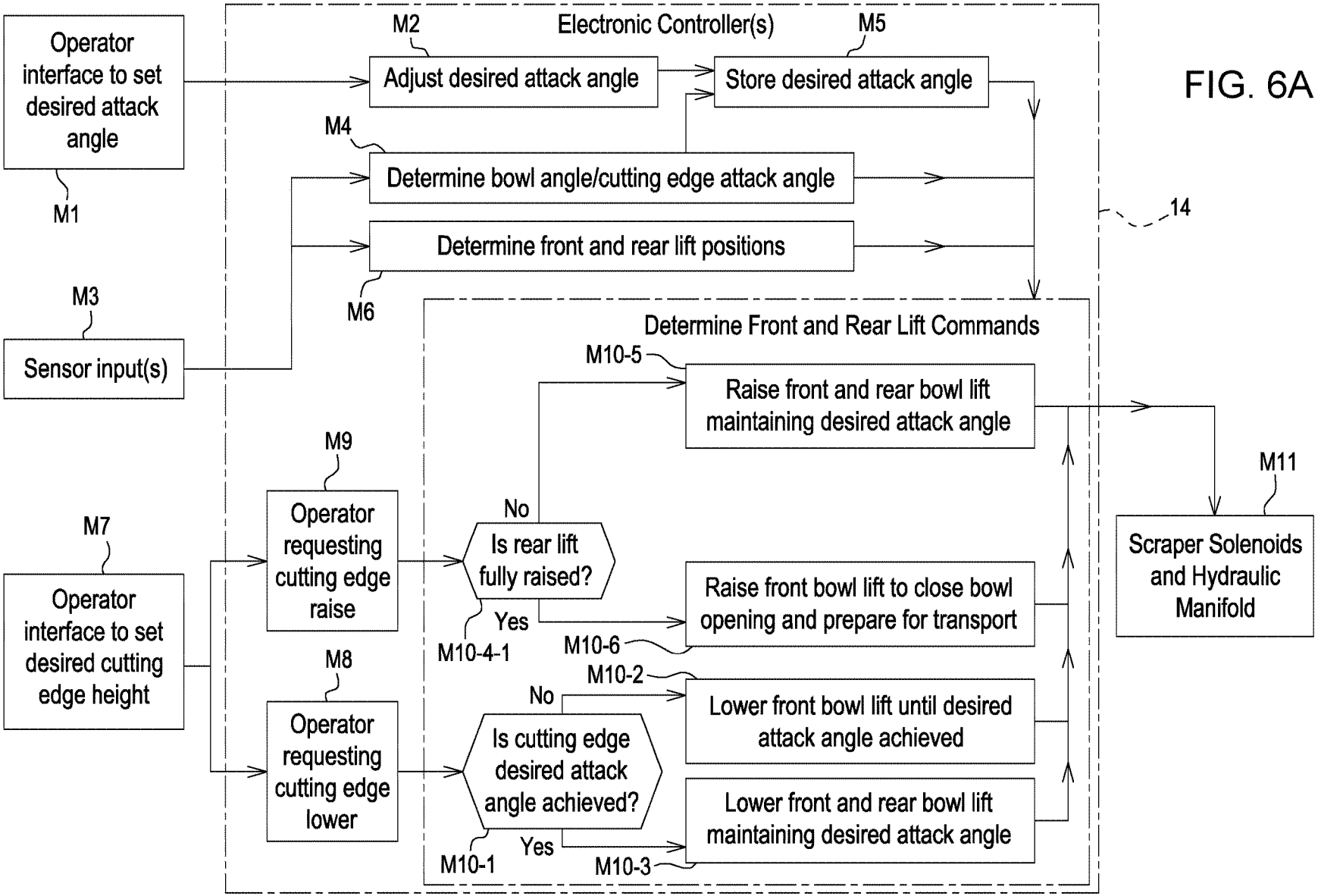
FIG. 6A is a flow chart of the bowl control.
Figure 6B:
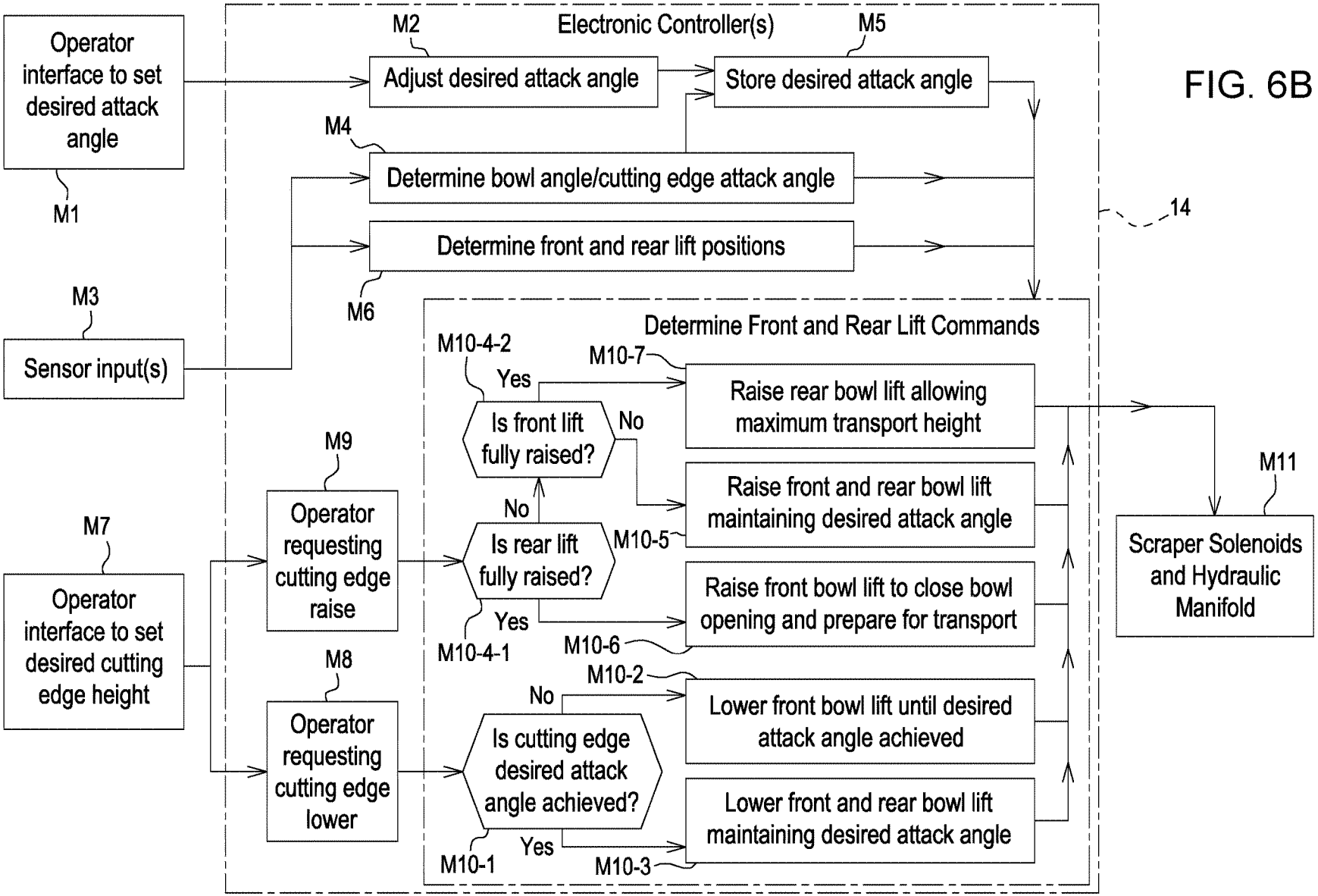
FIG. 6B is another flow chart of the bowl control.

FIG. 3A-3C shows the movement of the bowl 22 in one implementation when an operator lowers the bowl. FIG. 4A-4C shows the movement of the bowl 22 in another implementation when the operator lowers the bowl 22. FIG. 5A-5C shows the movement of the bowl 22 in one implementation when the operator raises the bowl 22. FIGS. 6A and 6B show methods of controlling the scraper. FIGS. 3A-5C demonstrates simplified version of the bowl 22, the first actuator 26, and the second actuator 28 to demonstrate the movement of the bowl 22 corresponding to some steps shown in FIGS. 6A and 6B.

Referring to FIG. 6A, three types of inputs, shown in step M1, M3, and M7, transmit to the (electronic) controllers 14.

Step M1: The operator uses operator interface 12 to set desired attack angle. In this implementation, the operator interface 12 may include a joystick (not shown).

Step M2: Receiving a signal indicative of a desired attack angle between a cutting edge of the scraper and the ground by a controller. Here, the signal from the operator interface 12 (joystick 122) is used to adjust or calibrate the attack angle to the desired attack angle. Therefore, the controller 14 will adopt this calibration with the measured attack angle to calculate the desired attack angle. For example, the measured attack angle plus the calibration equals desired attack angle. The controller 14 may later control the movement of the first actuator 26 and the second actuator 28 based on the calibration. In another implementation (not shown) the operator interface 12 is a touch screen and the operator utilizes the touch screen to set or adjust the desired attack angle. As such, the controller 14 may later control the movement of the first actuator 26 and the second actuator 28 based on the desired attack angle minus the measured attack angle. Different implementations of operator interfaces 12 transmit different signals indicative the desired attack angle to the controller 14.

Step M3: receiving one or more measuring signals from one or more sensors 30 by the controller 14.

Step M4: calculating a measured attack angle based on the one or more measuring signals.

Step M5: storing the desired attack angle. In this implementation, the memory of the controller 14 receive the data of adjustment/calibration and the data of measured attack angle. The controller 14 may calculate the desired attack angle after it receives the data of adjustment/calibration and the data of measured attack angle.

Step M6: calculating (measured) cutting edge height based on the one or more measuring signals. Based on one or more measuring signals, the position of the front portion 222 and the position of the rear portion 224 relative to the ground may be calculated or determined. With reference to the geometry, the (measured) cutting edge height is determined by the controller 14.

Step M7: receiving a height control signal to control a cutting edge height (set desired cutting edge height), which may be defined by a height of the cutting edge relative to the ground by the controller 14. The operator may use the joystick 124 to set or adjust the height.

The height control signal lowers or raises the cutting edge. In Step M8, the height control signal lowers the cutting edges (i.e., the operator requests the cutting edge lower). In Step M9, the height control signal raises the cutting edge (i.e., the operator requests the cutting edge raise).

Step M10: outputting at least one control signal to command movement of the bowl by the controller based on the height control signal and a difference between the measured attack angle and the desired attack angle. Step M10 is used to determine front and rear actuators (lifts) command. Step M10 includes Steps M10-1, M10-2, M10-3, M10-4-1, M10-5, and M10-6. Step M8 is followed by Step M10-1 and Step 10-2 or M10-3. Step M9 is followed by Step M10-4-1 and Step M10-5 or M10-6.

Step M8: lowering the cutting edge height.

Step M10-1: comparing the measured attack angle and the desired attack angle. When the measured attack angle is equal to the desired attack angle, go to Step M 10-3. When the measured attack angle is equal to the desired attack angle, go to Step M 10-2.

Step M10-2: The measured attack angle is not equal to the desired attack angle. For example, when the measured attack angle is shallower than the desired attack angle and the height control signal is received by the controller 14 to lower the height of cutting edge, the controller 14 outputs signals to command movement of the bowl 22, by solenoids valve and hydraulic manifold (Step M11). The controller 14 therefore controls the first actuator 26 to lower the front portion 222 of the bowl 22 to increase the measured attack angle (as shown from FIG. 3A to FIG. 3B) until the measured attack angle is equal to the desired attack angle (as shown in FIG. 3B). One instance for the measured attack angle is shallower than the desired attack angle is when the bowl 22 initiates from the store position (as shown in FIGS. 3A and 3B), which is used for transportation of the scraper 20.

It is noted that in another implementation, not only the first actuator 26 lowers the front portion 222 of the bowl 22, but also the second actuator 28 raises the rear portion 224 of the bowl 22, such that the measured attack angle reaches the desired attack angle quickly (as shown from FIG. 4A to FIG. 4B).

After attack angle achieves the desired attack angle and the height control signal is received by the controller 14 to keep lowering the height of cutting edge, Step M10-3 will be performed.

Step M10-3: when the measured attack angle is equal to the desired attack angle and the height control signal is received by the controller to lower the height of cutting edge, the controller 14 outputs signals to command movement of the bowl 22, by solenoids valve and hydraulic manifold (Step M11). The controller 14 therefore controls the first actuator 26 to lower the front portion 222 of the bowl 22 and the second actuator 28 to lower the rear portion 224 of the bowl 22 to move the bowl 22 in parallel relative to a direction to maintain the measured attack angle equal to the desired attack angle, as shown in FIGS. 3C and 4C. For instance, the bowl 22 is moved in parallel relative to the desired attack angle.

Step M9: raising the cutting edge height.

The measured attack angle, at the beginning, may be equal to the desired attack angle because the bowl 22 had been lowered and later maintained the measured attack angle equal to the desired attack angle during the lowering process, as described Step M10-3. It is noted that when the measured attack angle is equal to the desired attack angle and the height control signal is received by the controller 14 to raise the height of cutting edge, the first actuator 26 raises the front portion 222 of the bowl 22 and the second actuator 28 raises the rear portion 224 of the bowl 22 to move the bowl 22 in parallel relative to a direction to maintain the measured attack angle equal to the desired attack angle (as shown from FIG. 5A to FIG. 5B). For instance, the bowl 22 is moved in parallel relative to the desired attack angle. However, extension or retraction of the first actuator 26 and the second actuator 28 to raise the bowl has its limit. Once the limit is reached and the operator still raises the bowl 22, the bowl will move in a store position (travel position), which will be described in Step M10-6.

Step M10-4-1: determining whether the threshold of one of the first actuator 26 and the second actuator 28 is met when height control signal is received by the controller to raise the height of cutting edge. In one implementation, the threshold of one of the first actuator 26 and the second actuator 28 is a maximum extension or retraction of one of the first actuator 26 and the second actuator 28. Reaching the maximum extension or retraction of one of the first actuator 26 and the second actuator 28 defines one of the first actuator 26 and the second actuator 28 fully raised. Step M10-4-1 in FIG. 6A illustrates determining whether the second actuator 28 (rear lift) is fully raised.

Step M10-5: when the threshold of one of the first actuator 26 and the second actuator 28 is unmet and the height control signal is received by the controller 14 to raise the height of cutting edge, the controller 14 outputs signals to command movement of the bowl 22, by solenoids valve and hydraulic manifold (Step M11). The controller 14 therefore controls the first actuator 26 to raise the front portion 222 of the bowl 22 and the second actuator 28 to raise the rear portion 224 of the bowl 22 to move the bowl 22 in parallel relative to a direction to maintain the measured attack angle equal to the desired attack angle (as shown from FIG. 5A to FIG. 5B). For instance, the bowl 22 is moved in parallel relative to the desired attack angle.

Step M10-6: when the threshold of one of the first actuator 26 and the second actuator 28 is met and the height control signal is received by the controller 14 to raise the height of cutting edge, the controller 14 outputs signals to command movement of the bowl 22, by solenoids valve and hydraulic manifold (Step M11). The controller 14 therefore controls the other one of the first actuator 26 or the second actuator 28 continues to raise the front portion 222 or the rear portion 224 of the bowl 22 to reach a store position for transportation of the scraper 20. Step M10-6 in FIG. 6A illustrates that when the threshold of the second actuator 28 is met, defined by the second actuator 28 fully raised, the first actuator 26 continues to raise the front portion 222 of the bowl 22 to reach a store position for transportation of the scraper 20 (as shown in FIG. 5C).

Compared to FIG. 6A, FIG. 6B includes additional Step M10-4-2 and Step M10-7. Step M10-4-2 illustrates determining whether the first actuator 26 (front lift) is fully raised. The threshold of the first actuator 26 is met and the height control signal is received by the controller 14 to raise the height of cutting edge, the controller 14 outputs signals to command movement of the bowl 22, by solenoids valve and hydraulic manifold (Step M11). The controller 14 therefore controls the second actuator 28 continues to raise the rear portion 224 of the bowl 22 to reach a store position for transportation of the scraper 20, as shown in Step M10-7.

Without in any way limiting the scope, interpretation, or application of the claims appearing below, a technical effect of one or more of the example embodiments disclosed herein is to allow the user, by merely pre-setting a desired attack angle and adjusting the cutting edge height in real time, to easily maintain the attack angle even if the cutting edge height varies. Another technical effect of one or more of the example embodiments disclosed herein is adjust the attack angle easily via the at least two pivot units respectively positioned in the front portion and rear portion of the bowl. Another technical effect of one or more of the example embodiments disclosed herein is to automatically raise the bowl into a store position when one of the first or second actuators reach its threshold (i.e., the bowl fully raised).

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A control method to operate a scraper over ground, the scraper having a first actuator coupled to a front portion of a bowl and a second actuator coupled to a rear portion of the bowl, the control method comprising:

receiving a signal indicative of a desired attack angle between a cutting edge of the scraper and the ground;

receiving a height control signal, from an operator interface, to control a cutting edge height;

receiving one or more measuring signals from one or more sensors;

calculating a measured attack angle based on the one or more measuring signals;

comparing the measured attack angle and the desired attack angle;

outputting at least one control signal commanding movement of the bowl of the scraper based on the height control signal and a result of the comparing the measured attack angle and the desired attack angle; and in response to the at least one control signal, extending or retracting at least one of the first actuator coupled to the front portion of the bowl and the second actuator coupled to the rear portion of the bowl to move the bowl.

2. The control method of claim 1, wherein, when the measured attack angle is equal to the desired attack angle, the extending or retracting comprises moving the bowl in parallel relative to a direction by the first actuator and the second actuator to maintain the measured attack angle equal to the desired attack angle.

3. The control method of claim 1, wherein, when the measured attack angle is equal to the desired attack angle and the height control signal is received by a controller to lower the height of cutting edge, the extending or retracting comprises the first actuator lowering the front portion of the bowl and the second actuator lowering the rear portion of the bowl to move the bowl in parallel relative to a direction to maintain the measured attack angle equal to the desired attack angle.

4. The control method of claim 1, wherein, when the measured attack angle is shallower than the desired attack angle and the height control signal is received by a controller to lower the height of cutting edge, the extending or retracting comprises the first actuator lowering the front portion of the bowl to increase the measured attack angle until the measured attack angle is equal to the desired attack angle.

5. The control method of claim 4, wherein, when the measured attack angle achieves the desired attack angle and the height control signal is received by the controller to lower the height of cutting edge, the extending or retracting comprises the first actuator lowering the front portion of the bowl and the second actuator lowering the rear portion of the bowl to move the bowl in parallel relative to a direction to maintain the measured attack angle equal to the desired attack angle.

6. The control method of claim 4, wherein the extending or retracting comprises the first actuator lowering the front portion of the bowl from a store position of the bowl, which is used for transportation of the scraper.

7. The control method of claim 1, wherein, when the measured attack angle is equal to the desired attack angle and the height control signal is received by a controller to raise the height of cutting edge, the extending or retracting comprises the first actuator raising the front portion of the bowl and the second actuator raising the rear portion of the bowl to move the bowl in parallel relative to a direction to maintain the measured attack angle equal to the desired attack angle.

8. The method of claim 1, wherein, when the height control signal is received by a controller to raise the height of cutting edge, the extending or retracting comprises raising the cutting edge height and determining whether a threshold of one of the first actuator and the second actuator is met.

9. The method of claim 8, wherein the threshold of one of the first actuator and the second actuator is a maximum extension or retraction of one of the first actuator and the second actuator.

10. The method of claim 8, wherein, when the threshold of one of the first actuator and the second actuator is unmet and the height control signal is received by the controller to raise the height of cutting edge, the extending or retracting comprises the first actuator raising the front portion of the bowl and the second actuator raising the rear portion of the bowl to move the bowl in parallel relative to a direction to maintain the measured attack angle equal to the desired attack angle.

11. The method of claim 8, wherein, when the threshold of one of the first actuator and the second actuator is met and the height control signal is received by the controller to raise the height of cutting edge, the extending or retracting comprises the other one of the first actuator and the second actuator continuing to raise the front portion or the rear portion of the bowl to reach a store position for transportation of the scraper.

12. The method of claim 11, wherein, when the threshold of the second actuator is met, defined by the second actuator fully raised, the extending or retracting comprises the first actuator continuing to raise the front portion of the bowl to reach the store position for transportation of the scraper.

13. The method of claim 1, wherein the one or more sensors include a first displacement sensor measuring movement of the first actuator and a second displacement sensor measuring movement of the second actuator.

14. The method of claim 1, wherein the one or more sensors include a first angle sensor measuring a rotation of a first pivot unit caused by movement of the first actuator and a second angle sensor measuring a rotation of a second pivot unit caused by movement of the second actuator.

15. The method of claim 1, wherein the one or more sensors include a displacement sensor measuring movement of one of the first actuator and the second actuator and an angle sensor measuring a rotation of a second pivot unit caused by movement of one of the first actuator and the second actuator.

16. The method of claim 1, wherein the one or more sensors includes an inertial measurement unit and one of a first displacement sensor measuring movement of the first actuator and a second displacement sensor measuring movement of the second actuator.

17. The method of claim 1, wherein the one or more sensors include a first distance sensor measuring height of the first distance sensor relative to the ground and a second distance sensor measuring height of the second distance sensor relative to the ground.

* * * * *